US008943647B1

(12) United States Patent
Henderson

(10) Patent No.: US 8,943,647 B1
(45) Date of Patent: Feb. 3, 2015

(54) VACUUM CLEANER INCLUDING A REMOVABLE HANDLE ASSEMBLY

(71) Applicant: Techtronic Floor Care Technology Limited, Tortola (VG)

(72) Inventor: Gregg A. Henderson, Munroe Falls, OH (US)

(73) Assignee: Techtronic Floor Care Technology Limited, Tortola (VG)

( * ) Notice: Subject to any disclaimer, the term of this patent is extended or adjusted under 35 U.S.C. 154(b) by 7 days.

(21) Appl. No.: 13/963,648

(22) Filed: Aug. 9, 2013

(51) Int. Cl.
*A47L 5/28* (2006.01)
*A47L 9/32* (2006.01)

(52) U.S. Cl.
CPC ..... *A47L 5/28* (2013.01)
USPC ..... 15/347; 15/328

(58) Field of Classification Search
CPC ..... A47L 5/28; A47L 5/24; A47L 5/225; A47L 9/1683; A47L 11/4069; A47L 11/204
USPC ..... 15/347, 350–353, 327.1, 327.5, 328, 15/329
See application file for complete search history.

(56) References Cited

U.S. PATENT DOCUMENTS

| | | | |
|---|---|---|---|
| 1,884,871 | A | 10/1932 | Riebel, Jr. |
| 2,898,621 | A | 8/1959 | Vance |
| 2,898,622 | A | 8/1959 | Hurd |
| 3,126,570 | A | 3/1964 | Green |
| 3,758,914 | A | 9/1973 | Nupp |
| 3,766,594 | A | 10/1973 | Westergren |
| 4,393,536 | A | 7/1983 | Tapp |
| 4,635,315 | A | 1/1987 | Kozak |
| 4,644,605 | A | 2/1987 | Joss et al. |
| 4,662,026 | A | 5/1987 | Sumerau et al. |
| 4,876,763 | A | 10/1989 | Cho et al. |
| D307,657 | S | 5/1990 | Li |
| 4,947,512 | A | 8/1990 | Lackner et al. |
| 4,959,885 | A | 10/1990 | Sovis et al. |
| 5,054,157 | A | 10/1991 | Werner et al. |
| 5,187,832 | A | 2/1993 | Meyer et al. |

(Continued)

FOREIGN PATENT DOCUMENTS

| | | |
|---|---|---|
| EP | 0887040 | 12/1998 |
| EP | 1190660 | 3/2002 |

(Continued)

OTHER PUBLICATIONS

International Search Report and Written Opinion for Application No. PCT/US2013/054374 dated Apr. 8, 2014 (11 pages).

*Primary Examiner* — Dung Van Nguyen
(74) *Attorney, Agent, or Firm* — Michael Best & Friedrich LLP

(57) ABSTRACT

A vacuum cleaner includes a base having a foot with a suction nozzle and a handle assembly removably coupled to the foot. The handle assembly is movable between a first position, in which the handle assembly is connected to the foot, and a second position, in which the handle assembly is disconnected to the foot. The vacuum cleaner also includes a canister assembly supported by the base. The canister assembly is removable from the base. The vacuum cleaner further includes a latch supported by one of the foot and the handle assembly. The latch is engageable with the other of the foot and the handle assembly to selectively secure the handle assembly to the foot. The latch is inaccessible when the canister assembly is supported by the base.

26 Claims, 16 Drawing Sheets

(56) References Cited

U.S. PATENT DOCUMENTS

| | | | | |
|---|---|---|---|---|
| 5,309,600 | A | 5/1994 | Weaver et al. | |
| 5,524,321 | A | 6/1996 | Weaver et al. | |
| 5,659,922 | A | 8/1997 | Louis | |
| 5,715,566 | A | 2/1998 | Weaver et al. | |
| 5,819,364 | A | 10/1998 | Sham | |
| 5,836,047 | A | 11/1998 | Lee et al. | |
| 5,842,254 | A | 12/1998 | Lee | |
| 5,970,575 | A | 10/1999 | Lee | |
| 6,058,559 | A | 5/2000 | Yoshimi et al. | |
| 6,070,291 | A | 6/2000 | Bair et al. | |
| 6,094,775 | A | 8/2000 | Behmer | |
| 6,122,796 | A | 9/2000 | Downham et al. | |
| 6,256,834 | B1 | 7/2001 | Meijer et al. | |
| 6,260,234 | B1 | 7/2001 | Wright | |
| 6,295,692 | B1 | 10/2001 | Shideler | |
| 6,311,366 | B1 | 11/2001 | Sepke et al. | |
| 6,363,571 | B1 * | 4/2002 | Block et al. | 15/335 |
| 6,374,453 | B1 | 4/2002 | Kim | |
| 6,385,810 | B1 | 5/2002 | Lang | |
| 6,536,072 | B2 | 3/2003 | Thur et al. | |
| 6,558,453 | B2 | 5/2003 | Sepke et al. | |
| 6,574,831 | B2 | 6/2003 | Hunter et al. | |
| 6,588,055 | B2 | 7/2003 | Bair et al. | |
| 6,735,818 | B2 | 5/2004 | Hamada et al. | |
| 6,775,882 | B2 | 8/2004 | Murphy et al. | |
| 6,779,229 | B2 | 8/2004 | Lee et al. | |
| 6,782,584 | B2 | 8/2004 | Choi | |
| 6,839,934 | B2 | 1/2005 | Houghton et al. | |
| 6,961,975 | B2 | 11/2005 | Park et al. | |
| RE38,949 | E | 1/2006 | Wright et al. | |
| 7,134,166 | B2 | 11/2006 | Wright et al. | |
| 7,222,392 | B2 | 5/2007 | McCormick et al. | |
| 7,247,181 | B2 | 7/2007 | Hansen et al. | |
| 7,254,864 | B2 | 8/2007 | Cipolla et al. | |
| 7,350,266 | B2 * | 4/2008 | Park et al. | 15/410 |
| 7,360,274 | B2 | 4/2008 | Park et al. | |
| 7,377,008 | B2 | 5/2008 | Park et al. | |
| 7,380,308 | B2 | 6/2008 | Oh et al. | |
| 7,386,917 | B2 | 6/2008 | Gogel et al. | |
| 7,555,808 | B2 | 7/2009 | Oh et al. | |
| 7,587,786 | B2 | 9/2009 | Zahuranec et al. | |
| 7,594,296 | B2 | 9/2009 | Park | |
| 7,600,291 | B2 | 10/2009 | Choi | |
| 7,624,475 | B2 | 12/2009 | Choi | |
| 7,694,383 | B2 | 4/2010 | Zahuranec et al. | |
| 7,797,792 | B2 | 9/2010 | Cipolla et al. | |
| 7,836,546 | B2 | 11/2010 | Yoo et al. | |
| 7,882,593 | B2 | 2/2011 | Beskow | |
| 7,934,286 | B2 | 5/2011 | Yoo et al. | |
| 7,937,802 | B2 * | 5/2011 | Yoo et al. | 15/329 |
| 7,950,103 | B2 | 5/2011 | Williamson et al. | |
| 7,979,953 | B2 | 7/2011 | Yoo | |
| 8,032,981 | B2 | 10/2011 | Yoo | |
| 8,069,529 | B2 | 12/2011 | Groff et al. | |
| 8,074,321 | B2 | 12/2011 | Fry et al. | |
| 8,127,398 | B2 | 3/2012 | Conrad | |
| 8,166,607 | B2 | 5/2012 | Conrad | |
| 8,191,203 | B2 | 6/2012 | Yoo | |
| 8,196,257 | B2 | 6/2012 | Hanschur | |
| 8,225,456 | B2 | 7/2012 | Hakan et al. | |
| 8,240,003 | B2 | 8/2012 | Gammack et al. | |
| 8,302,251 | B2 | 11/2012 | Beskow et al. | |
| 8,370,993 | B2 | 2/2013 | Conrad | |
| 8,438,697 | B2 | 5/2013 | Kim et al. | |
| 8,453,294 | B2 | 6/2013 | Lee | |
| 8,468,646 | B2 | 6/2013 | Yoo | |
| 8,661,610 | B2 * | 3/2014 | Liu et al. | 15/351 |
| 2004/0134022 | A1 | 7/2004 | Murphy et al. | |
| 2006/0026789 | A1 | 2/2006 | Fischer et al. | |
| 2006/0137128 | A1 | 6/2006 | Elsworthy et al. | |
| 2006/0213024 | A1 | 9/2006 | Lee et al. | |
| 2006/0218741 | A1 | 10/2006 | Kang | |
| 2007/0028413 | A1 | 2/2007 | Fischer et al. | |
| 2007/0039118 | A1 | 2/2007 | Choi | |
| 2007/0226947 | A1 | 10/2007 | Kang | |
| 2007/0289085 | A1 | 12/2007 | Yoo | |
| 2008/0040883 | A1 | 2/2008 | Beskow et al. | |
| 2008/0104793 | A1 | 5/2008 | Kang et al. | |
| 2008/0178416 | A1 | 7/2008 | Conrad | |
| 2009/0031522 | A1 | 2/2009 | Yoo et al. | |
| 2009/0144929 | A1 | 6/2009 | Yoo | |
| 2009/0144932 | A1 | 6/2009 | Yoo | |
| 2009/0241284 | A1 | 10/2009 | Mayes et al. | |
| 2010/0095476 | A1 | 4/2010 | Kim et al. | |
| 2010/0139030 | A1 | 6/2010 | Yoo | |
| 2010/0229336 | A1 | 9/2010 | Conrad | |
| 2011/0219567 | A1 | 9/2011 | Conrad | |
| 2011/0314629 | A1 | 12/2011 | Conrad | |
| 2012/0000030 | A1 | 1/2012 | Conrad | |
| 2012/0023701 | A1 | 2/2012 | Lenkiewicz et al. | |
| 2012/0090105 | A1 | 4/2012 | Henderson | |
| 2012/0204378 | A1 | 8/2012 | Conrad | |
| 2012/0222235 | A1 | 9/2012 | Lenkiewicz et al. | |
| 2014/0041149 | A1 * | 2/2014 | Henderson et al. | 15/347 |
| 2014/0237754 | A1 * | 8/2014 | Conrad | 15/328 |

FOREIGN PATENT DOCUMENTS

| | | |
|---|---|---|
| GB | 2451925 | 2/2009 |
| GB | 2455378 | 6/2009 |

* cited by examiner

VACUUM CLEANER INCLUDING A REMOVABLE HANDLE ASSEMBLY

BACKGROUND

The present invention relates to vacuum cleaners and, more particularly, to upright vacuum cleaners.

Upright vacuum cleaners are typically used to clean floor surfaces, such as carpeting. These types of vacuum cleaners, however, can be difficult to maneuver and operate in relatively confined areas. In addition, it is sometimes desirable to clean elevated surfaces, such as drapes, furniture, or steps, with a vacuum cleaner.

SUMMARY

In one embodiment, the invention provides a vacuum cleaner including a base having a foot with a suction nozzle and a handle assembly removably coupled to the foot. The handle assembly is movable between a first position, in which the handle assembly is connected to the foot, and a second position, in which the handle assembly is disconnected to the foot. The vacuum cleaner also includes a canister assembly supported by the base. The canister assembly is removable from the base. The vacuum cleaner further includes a latch supported by one of the foot and the handle assembly. The latch is engageable with the other of the foot and the handle assembly to selectively secure the handle assembly to the foot. The latch is inaccessible when the canister assembly is supported by the base.

In another embodiment, the invention provides a vacuum cleaner including a base having a foot with a suction nozzle and a handle assembly removably coupled to the foot. The handle assembly is movable between a first position, in which the handle assembly is connected to the foot, and a second position, in which the handle assembly is disconnected to the foot. The vacuum cleaner also includes a canister assembly supported by the base. The canister assembly is removable from the base. The vacuum cleaner further includes a foot pedal operable to release the handle assembly from the foot to allow movement of the handle assembly from the first position to the second position. The foot pedal is inoperable when the canister assembly is supported by the base.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1A:
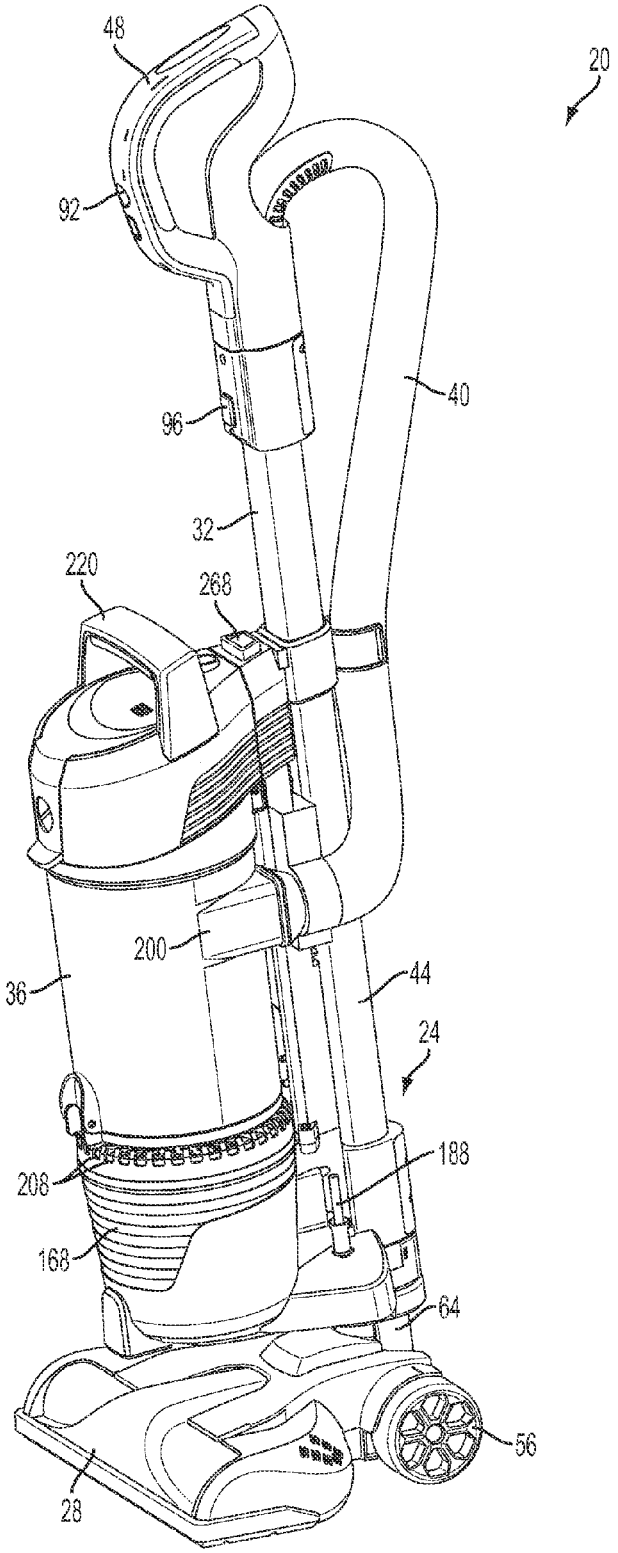
FIG. 1A is a perspective view of a vacuum cleaner embodying the invention, the vacuum cleaner including a foot, a handle assembly, and a canister assembly connected in a first operating mode, and the handle assembly being in an upright storage position.
Figure 1B:
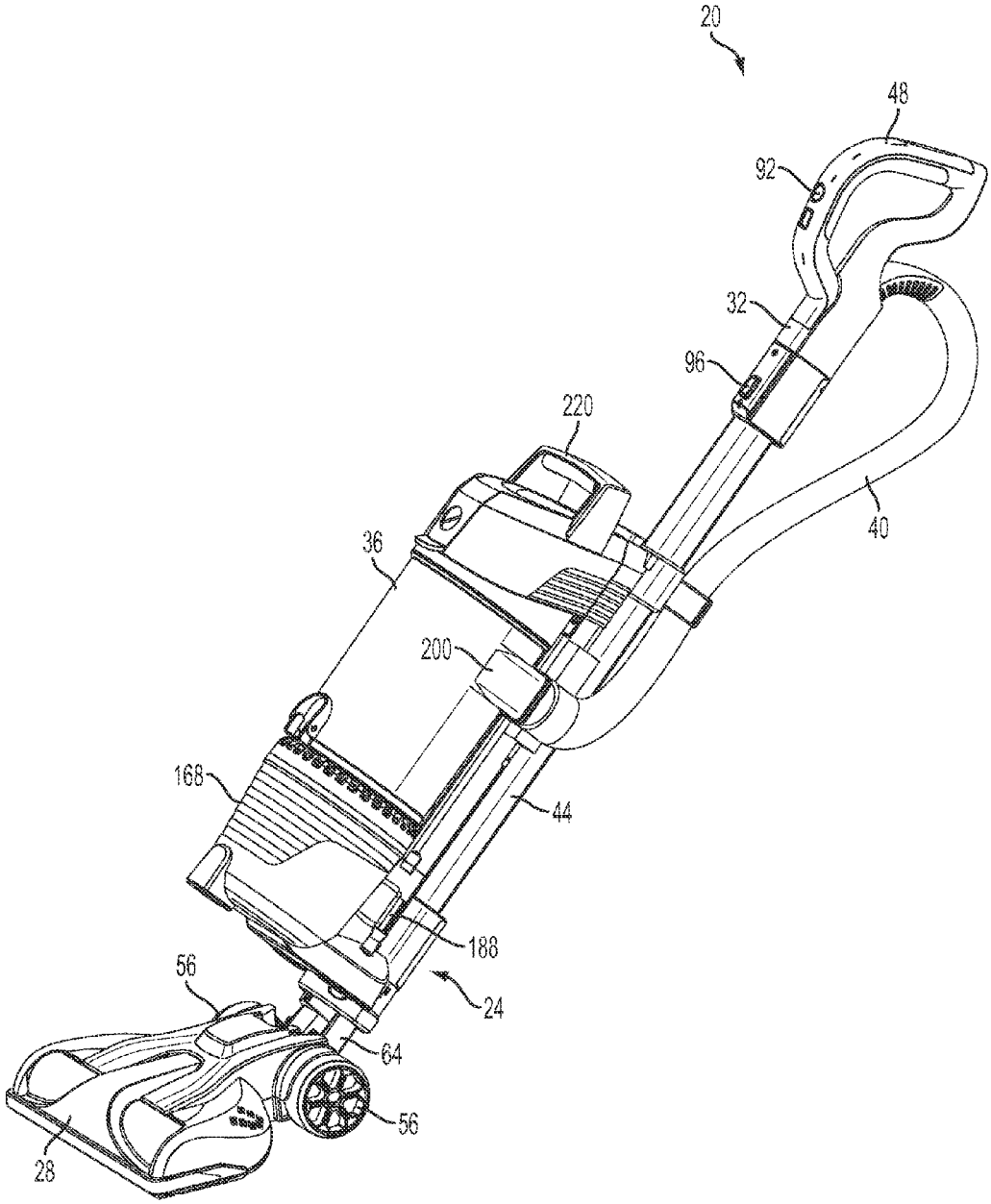
FIG. 1B is a perspective view of the vacuum cleaner with the foot, the handle assembly, and the canister assembly connected in the first operating mode, and the handle assembly being in an inclined operating position.

FIGS. 1A and 1B illustrate a vacuum cleaner 20. The illustrated vacuum cleaner 20 is an upright vacuum cleaner including a base 24 having a foot 28 and a handle assembly 32. The foot 28 is movable along a surface to be cleaned, such as a carpeted or hard-surface floor. The handle assembly 32 extends from the foot 28. The handle assembly 32 allows a user to move and manipulate the foot 28 along the surface. The handle assembly 32 is also movable relative to the foot 28 between an upright storage position (FIG. 1A) and an inclined operating position (FIG. 1B).

The vacuum cleaner 20 also includes a canister assembly 36 supported by the base 24. The canister assembly 36 generates a vacuum or suction force in the vacuum cleaner 20. The canister assembly 36 also removes and collects dirt or other particles from an airflow drawn into the vacuum cleaner 20 by the suction force.

In the illustrated embodiment, the handle assembly 32 is in fluid communication with the foot 28 such that an airflow drawn into the foot 28 is directed into the handle assembly 32. The handle assembly 32 is also in fluid communication with the canister assembly 36 through a flexible house 40 such that the airflow from the foot 28 is directed through the handle assembly 32, through the hose 40, and into the canister assembly 36. After the canister assembly 36 filters or otherwise cleans the airflow, the cleaned airflow is directed out of the vacuum cleaner 20 and back into the environment.

As shown in FIG. 1A-4, the illustrated vacuum cleaner 20 is operable in a variety of different cleaning modes. FIGS. 1A and 1B illustrate the vacuum cleaner 20 in a standard mode. In this mode, the handle assembly 32 is connected to the foot 28, and the canister assembly 36 is supported by the base 24. While in the standard mode, the vacuum cleaner 20 can be moved along a floor surface to clean the surface like a conventional vacuum cleaner.

Figure 2:
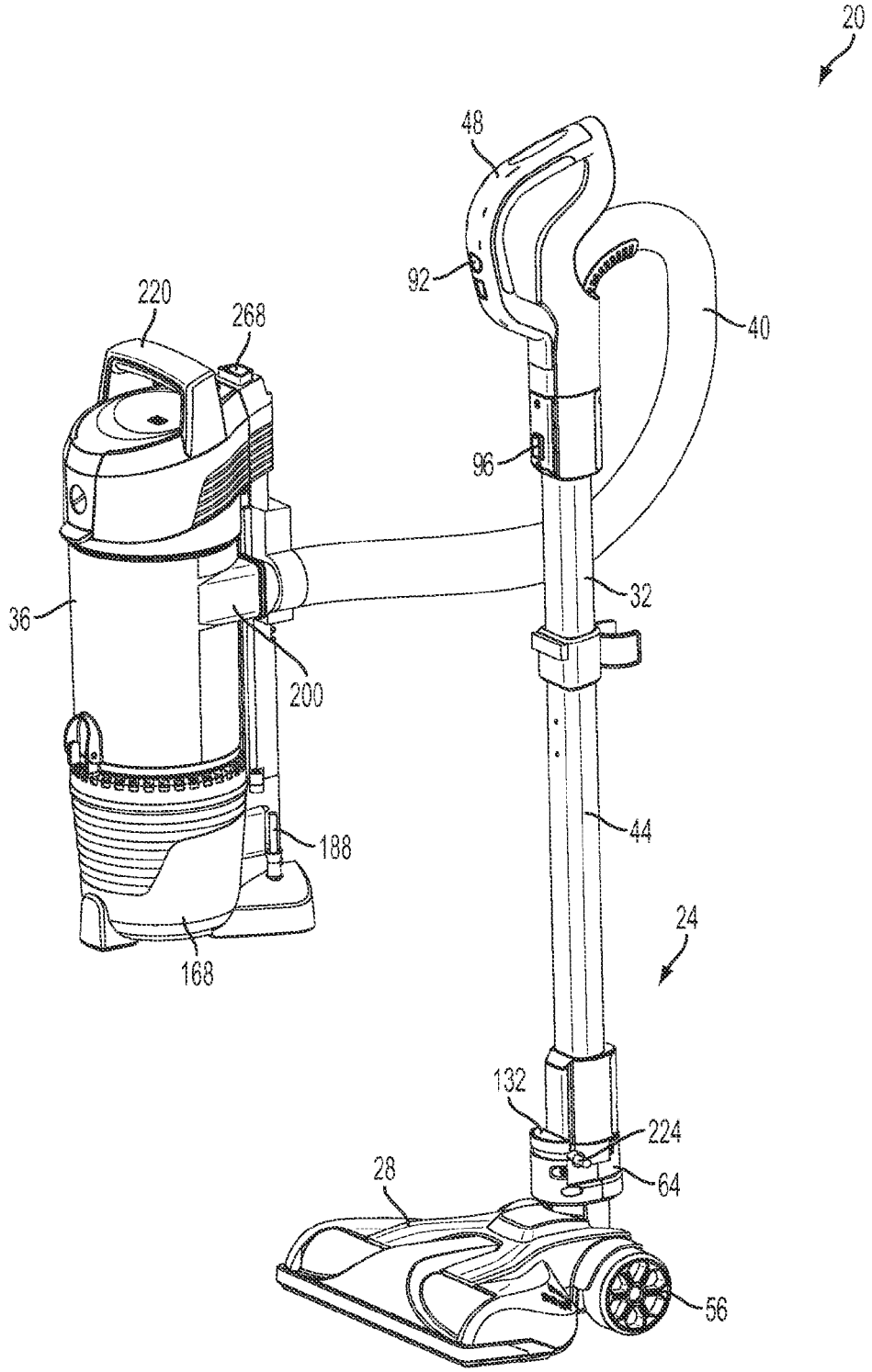
FIG. 2 is a perspective view of the vacuum cleaner with the foot, the handle assembly, and the canister assembly connected in a second operating mode.

FIG. 2 illustrates the vacuum cleaner 20 in a carry-along mode. In this mode, the handle assembly 32 is connected to the foot 28, but the canister assembly 36 is removed or separated from the base 24. While in the carry-along mode, a user can carry the canister assembly 36 apart from the handle assembly 32 and the foot 28.

Figure 3:
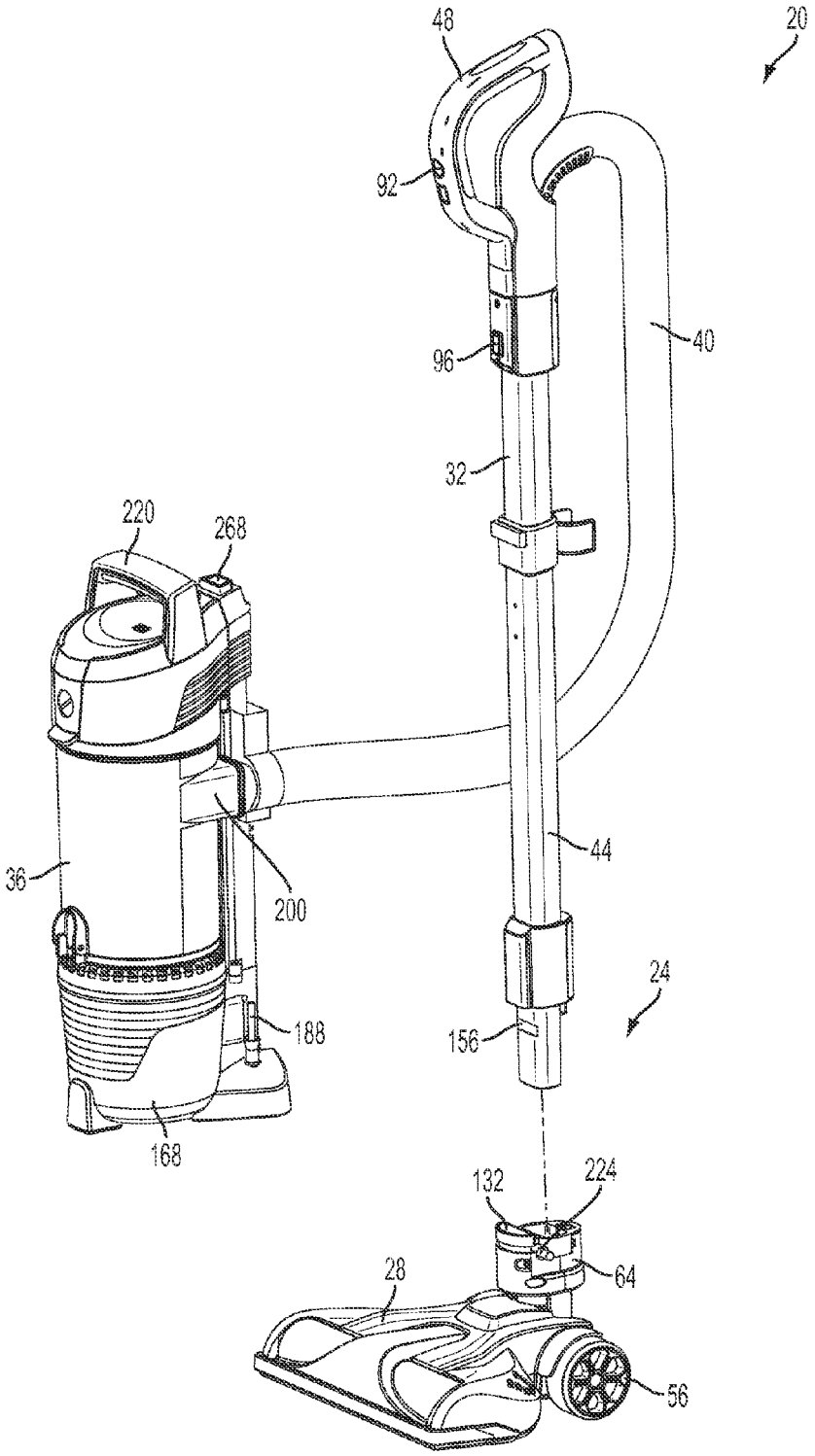
FIG. 3 is a perspective view of the vacuum cleaner with the foot, the handle assembly, and the canister assembly connected in a third operating mode.

FIG. 3 illustrates the vacuum cleaner 20 in a first above-the-floor mode. In this mode, the handle assembly 32 is disconnected from the foot 28, and the canister assembly 36 is removed or separated from both the handle assembly 32 and the foot 28. An accessory tool (e.g., a crevice tool, an upholstery tool, a pet tool, etc.) is then connectable to a free end of the handle assembly 32 (i.e., the end of the handle assembly 32 that connects to the foot 28) in place of the foot 28. While in the first above-the-floor mode, the handle assembly 32 can be used to clean non-floor surfaces (e.g., furniture, drapes, etc.) or steps while carrying the canister assembly 36 apart from the base 24.

Figure 4:
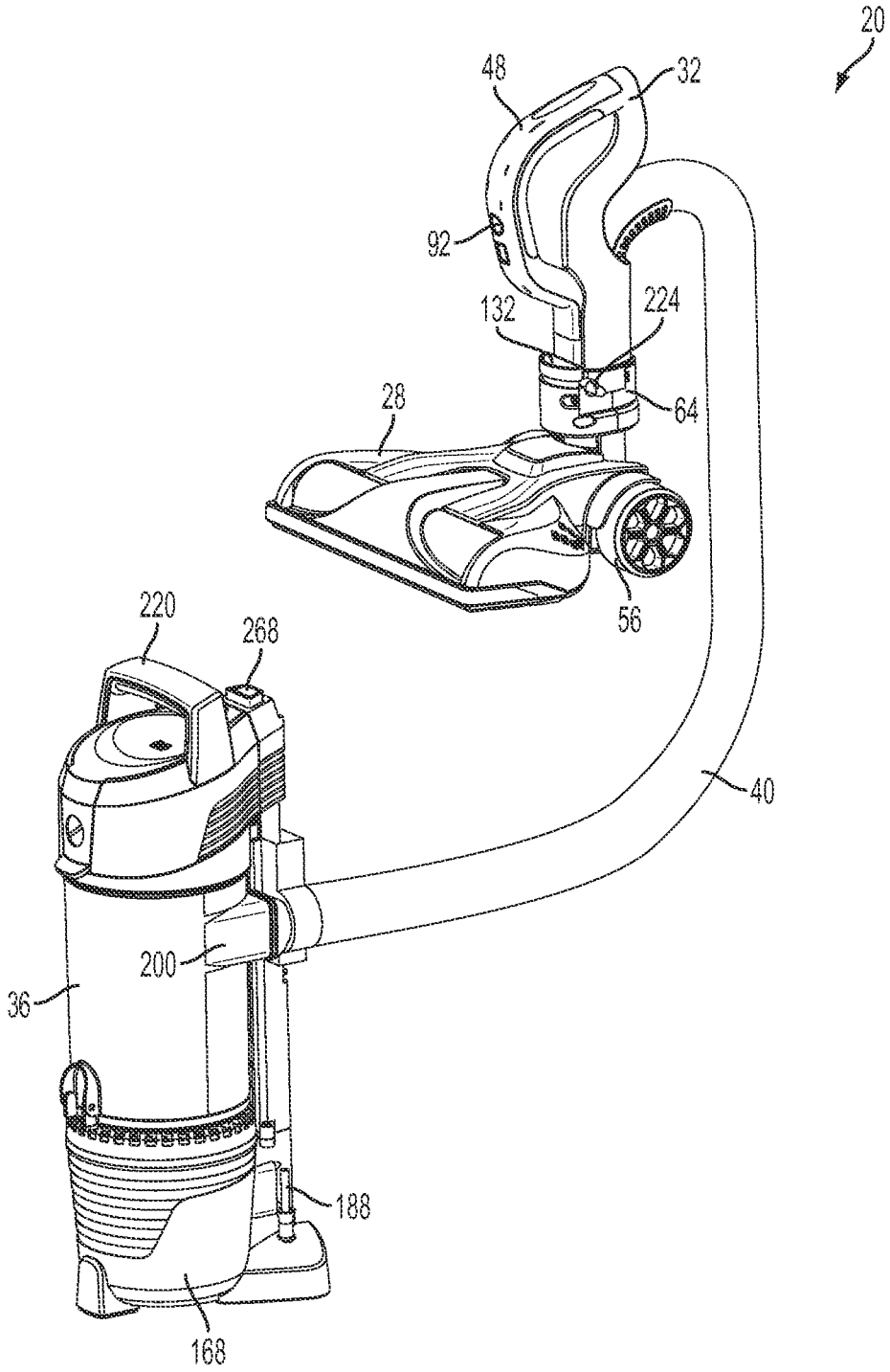
FIG. 4 is a perspective view of the vacuum cleaner with the foot, the handle assembly, and the canister assembly connected in a fourth operating mode.

FIG. 4 illustrates the vacuum cleaner 20 in a second above-the-floor mode. This mode is similar to first above-the-floor mode, except an extension tube 44 of the handle assembly 32 is removed so that an accessory tool (or even the foot 28, as shown in FIG. 4) can be connected directly to a grip 48 of the handle assembly 32. Such an arrangement allows a user to clean non-floor surfaces or steps with a much shorter handle assembly 32 while carrying the canister assembly 36.

Figure 5:
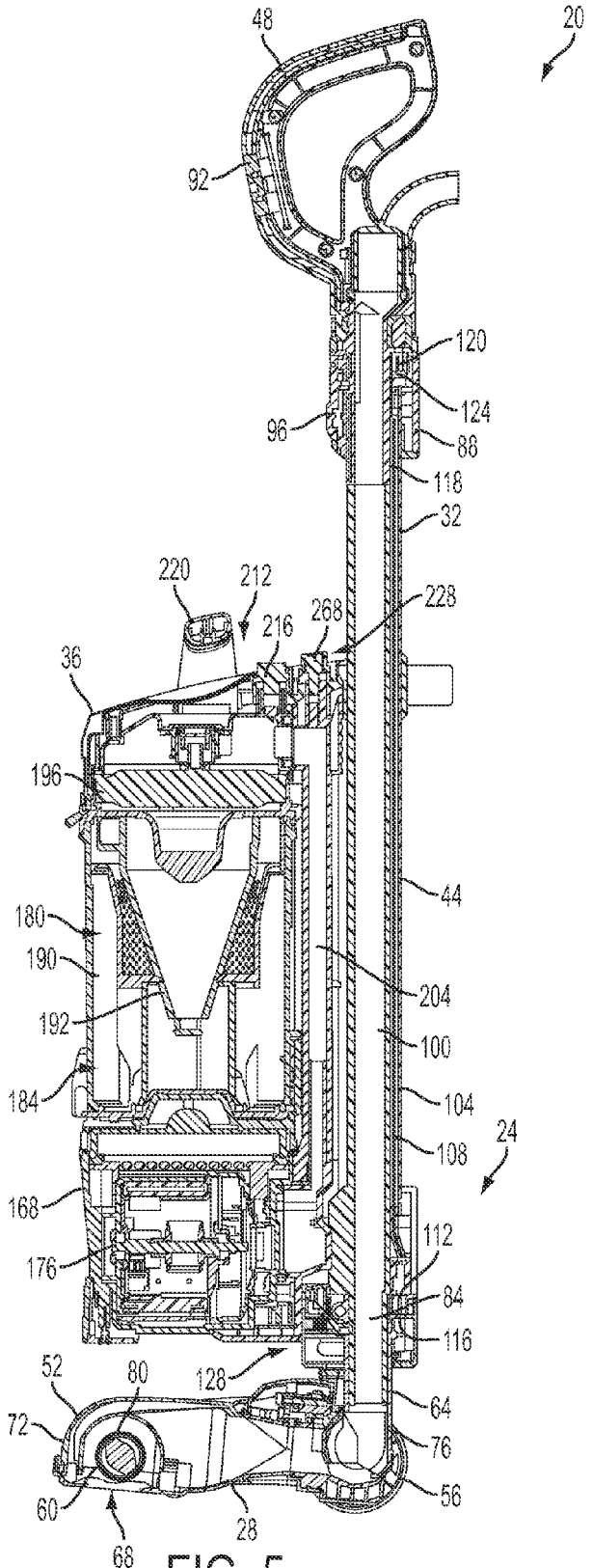
FIG. 5 is a cross-sectional view of the vacuum cleaner.
Figure 6:
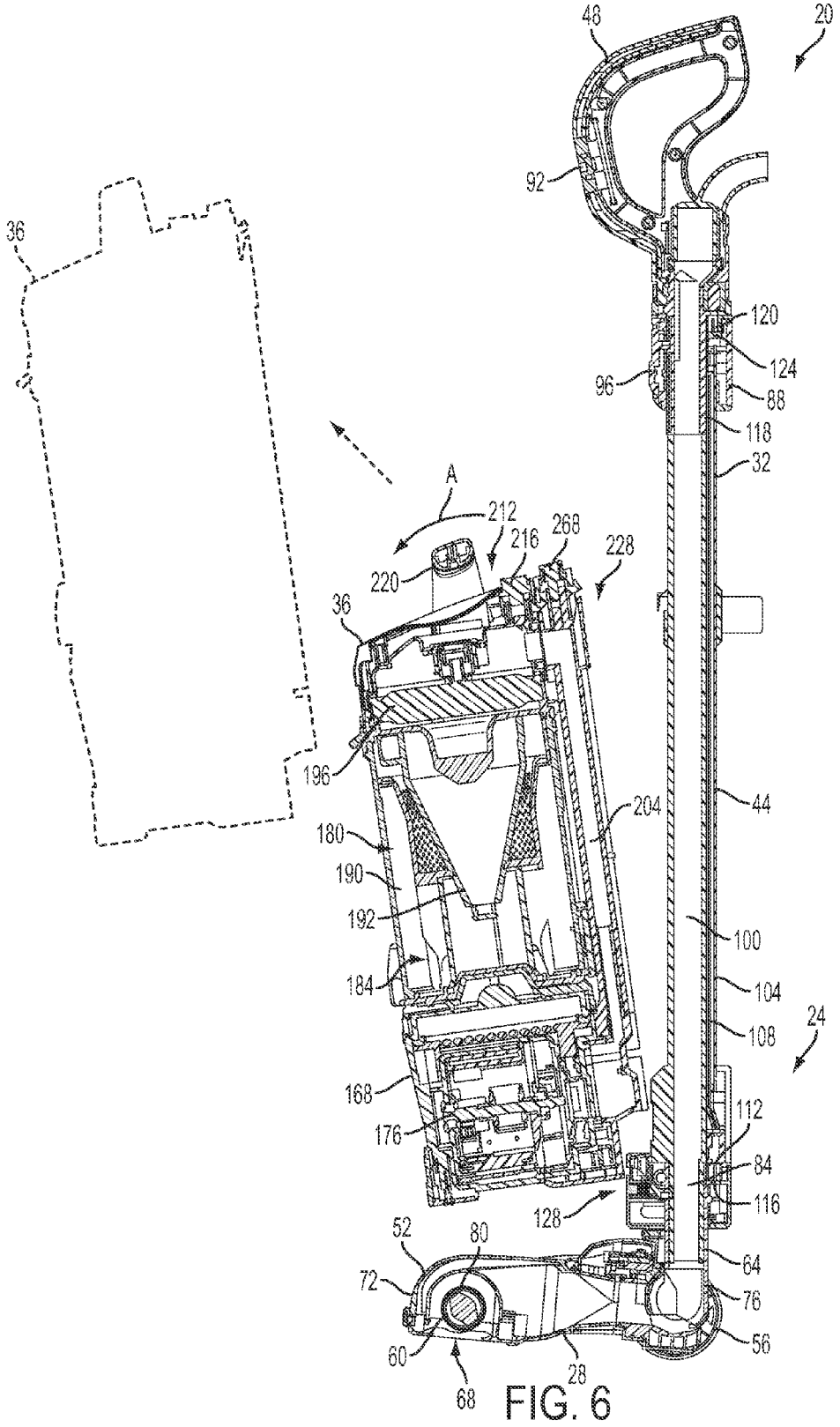
FIG. 6 is the cross-sectional view of the vacuum cleaner shown in FIG. 5 with the canister assembly pivoted away from the handle assembly.
Figure 7:
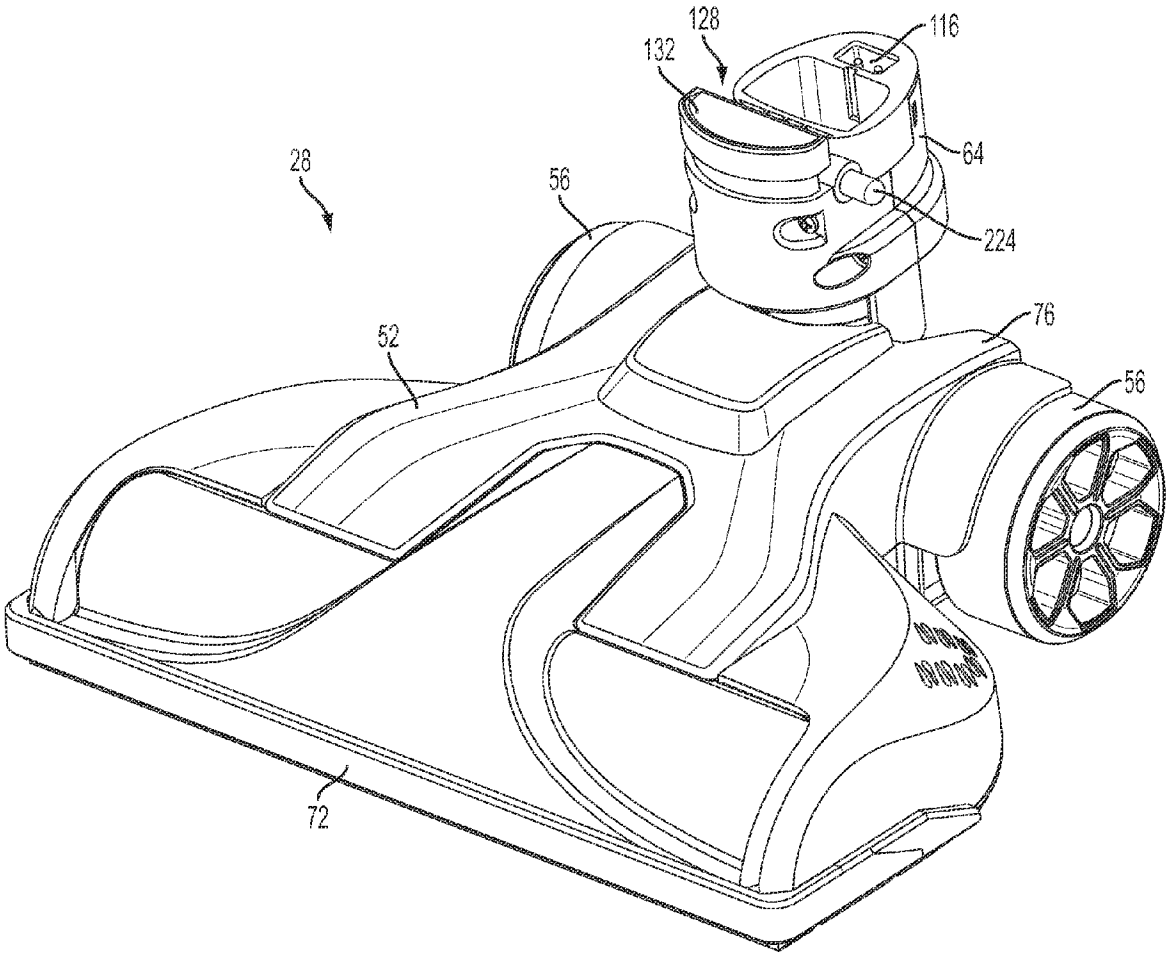
FIG. 7 is a top perspective view of the foot of the vacuum cleaner.

As shown in FIGS. 5-7, the foot 28 of the vacuum cleaner 20 includes a body 52, a plurality of wheels 56 coupled to the body 52, an agitator 60 positioned within the body 52, and a stem 64 extending from the body 52. The body 52 defines a suction nozzle 68 of the foot 28. The illustrated suction nozzle 68 is an opening formed in a bottom surface of the body 52 adjacent a forward end 72 of the foot 28. The suction nozzle 68 is in fluid communication with the handle assembly 32, and thereby the canister assembly 36, to direct air and dirt from the surface being cleaned into the vacuum cleaner 20.

The wheels 56 are coupled to the body 52 adjacent a rearward end 76 of the foot 28 (i.e., adjacent the stem 64 and the handle assembly 32). The wheels 56 facilitate moving the foot 28 along the surface being cleaned. In the illustrated embodiment, the foot 28 includes two wheels 56 positioned on opposing sides of the body 52. In other embodiments, the foot 28 may include fewer or more wheels. The wheels 56 may be idle wheels or driven wheels.

The agitator 60 is positioned within the body 52 adjacent the suction nozzle 68. The agitator 60 is coupled to a motor (not shown) that rotates the agitator 60 relative to the body 52. In the illustrated embodiment, the agitator 60 includes an elongated bar or shaft 80 that extends along the length of the suction nozzle 68. The bar 80 supports bristles, beater bars, and/or other suitable structures for agitating carpeting. In other embodiments, other suitable actuators may also or alternatively be employed.

The stem 64 extends from the rearward end 76 of the foot 28. The stem 64 receives a portion of the handle assembly 32 to connect the handle assembly 32 to the foot 28. The illustrated stem 64 is in fluid communication with the suction nozzle 68 such that air drawn into the foot 28 through the suction nozzle 68 is directed through the stem 64 and into the handle assembly 32. The stem 64 is also movable (e.g., rotatable) relative to the body 52 to move the handle assembly 32 relative to the foot 28 between the upright storage position (FIG. 1A) and the inclined operating position (FIG. 1B).

The illustrated handle assembly 32 includes the extension tube 44 and the grip 48. The extension tube 44 has a first end 84 and a second end 88. As shown in FIGS. 5 and 6, the first, or lower, end 84 is received in the stem 64 of the foot 28 to connect the handle assembly 32 to the foot 28. The second, or upper, end 88 supports the grip 48. The grip 48 is configured to be grasped by a user to manipulate and move the vacuum cleaner 20. The grip 48 also supports an actuator 92 (e.g., a power switch) that controls operation of the vacuum cleaner 20. The illustrated grip 48 is removably coupled to the extension tube 44 by a latch 96. The latch 96 is actuatable to disconnect the grip 48 from the extension tube 44 such that the vacuum cleaner 20 can be used without the extension tube 44 (as shown in, for example, FIG. 4).

The illustrated extension tube 44 also defines two conduits 100, 104. The conduits 100, 104 generally extend in parallel between the first and second ends 84, 88 of the extension tube 44. The illustrated conduits 100, 104 are isolated from (i.e., not in fluid communication with) each other. The first conduit 100 provides an airflow pathway from the foot 28 to the flexible hose 40 and, ultimately, to the canister assembly 36. The second conduit 104 provides an electrical pathway from the grip 48 to the foot 28. In particular, the second conduit 104 supports and encloses wires 108 that extend between the first and second ends 84, 88 of the extension tube 44.

Figure 8:
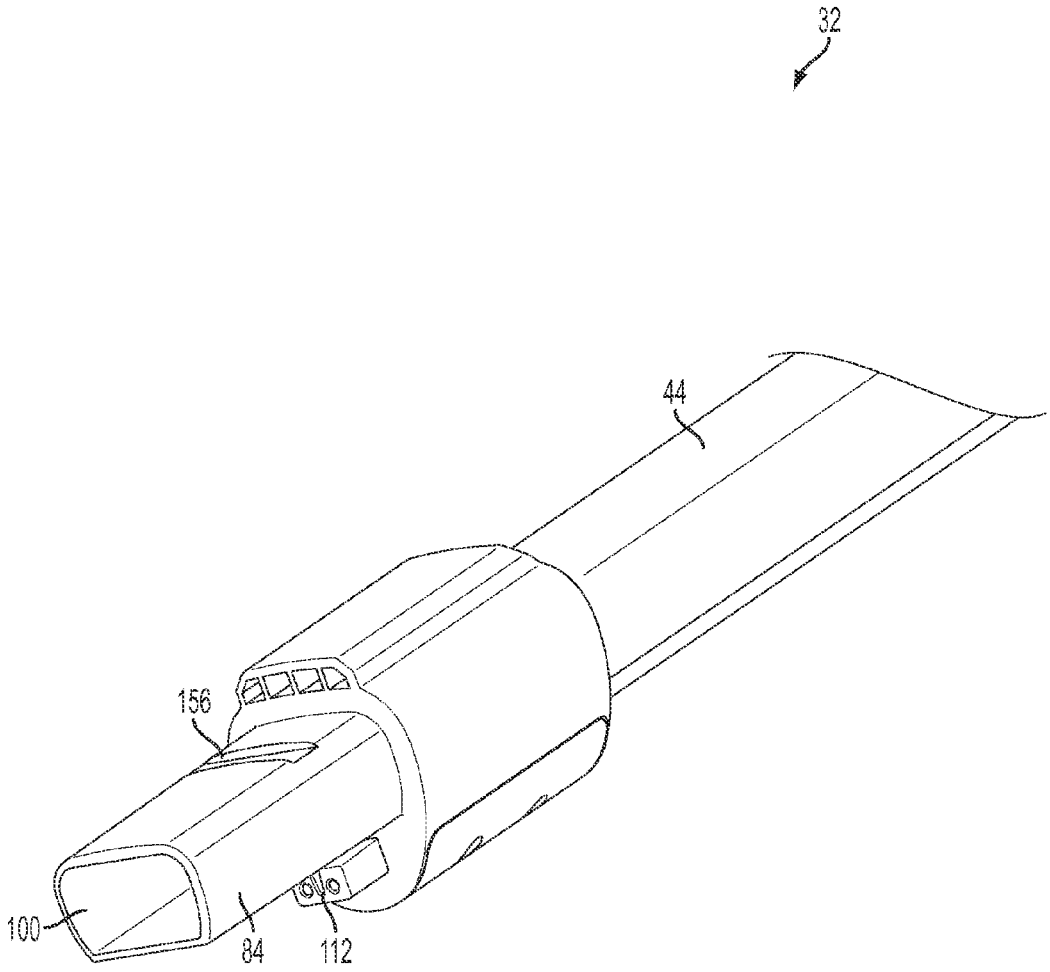
FIG. 8 is an end perspective view of a portion of the handle assembly.

As shown in FIG. 8, the extension tube 44 includes an electric plug 112 formed at the first end 84 of the tube 44. The plug 112 is connected to the wires 108 (FIGS. 5 and 6) in the second conduit 104 of the extension tube 44. As shown in FIG. 7, the stem 64 of the foot 28 includes an electric receptacle 116. The receptacle 116 is shaped and sized to receive the plug 112 (FIG. 8) of the extension tube 44 when the handle assembly 32 is connected to the foot 28. The plug 112 and the receptacle 116 electrically couple the foot 28 to the extension tube 44 to provide electrical power to the foot 28. Electrical power can be used to power components of the foot 28 such as, for example, the motor for the agitator 60 (FIGS. 5 and 6). When the foot 28 is disconnected from the handle assembly 32, as shown in FIG. 3, the plug 112 of the extension tube 44 can be plugged into other powered accessory tools having similarly shaped and sized electric receptacles as the foot 28.

Referring back to FIGS. 5 and 6, although not shown in detail, the grip 48 includes a male attachment end 118 and an electric plug 120 that are shaped and sized similar to the first end 84 and the electric plug 112 (FIG. 8) of the extension tube 44. In addition, the extension tube 44 includes an electric receptacle 124 at the second end 88 that is shaped and sized similar to the electric receptacle 116 in the foot 28. The attachment end 118 of the grip 48 is insertable into the second end 88 of the extension tube 44 to physically couple the grip 48 to the extension tube 44. The plug 120 and the receptacle 124 electrically couple the grip 48 to the extension tube 44 and, ultimately, to the foot 28. Furthermore, the male attachment end 118 and the plug 120 allow the grip 48 to be plugged directly into the foot 28 (or other powered accessory tool) when the extension tube 44 is removed, as shown in FIG. 4. Such an arrangement provides universal, modular connections between the grip 48, the extension tube 44, the foot 28, and other accessory tools.

Figure 9:
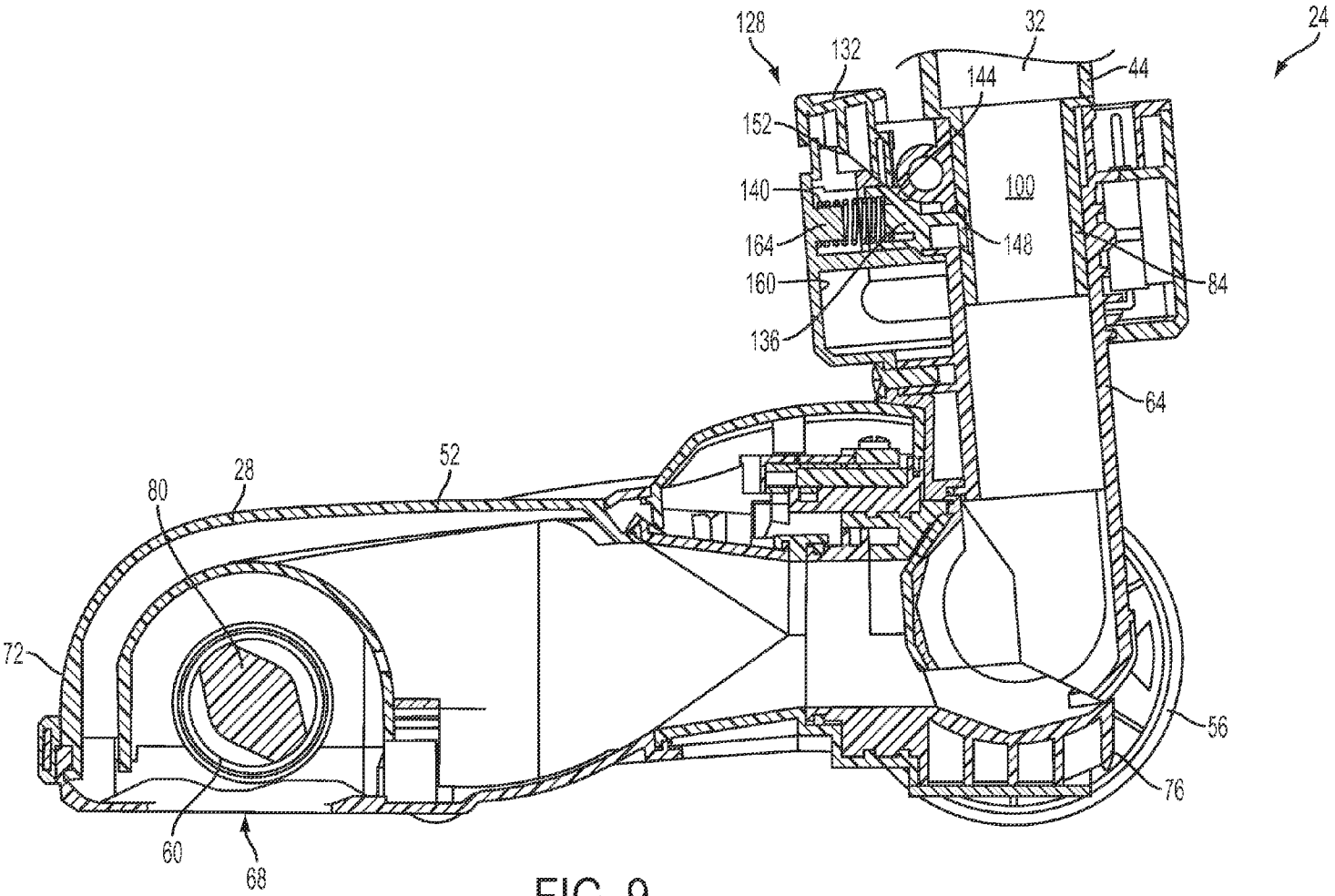
FIG. 9 is a cross-sectional view of a portion of the vacuum cleaner illustrating an interface between the handle assembly and the foot, the foot supporting a latch in an engaged position.
Figure 10:
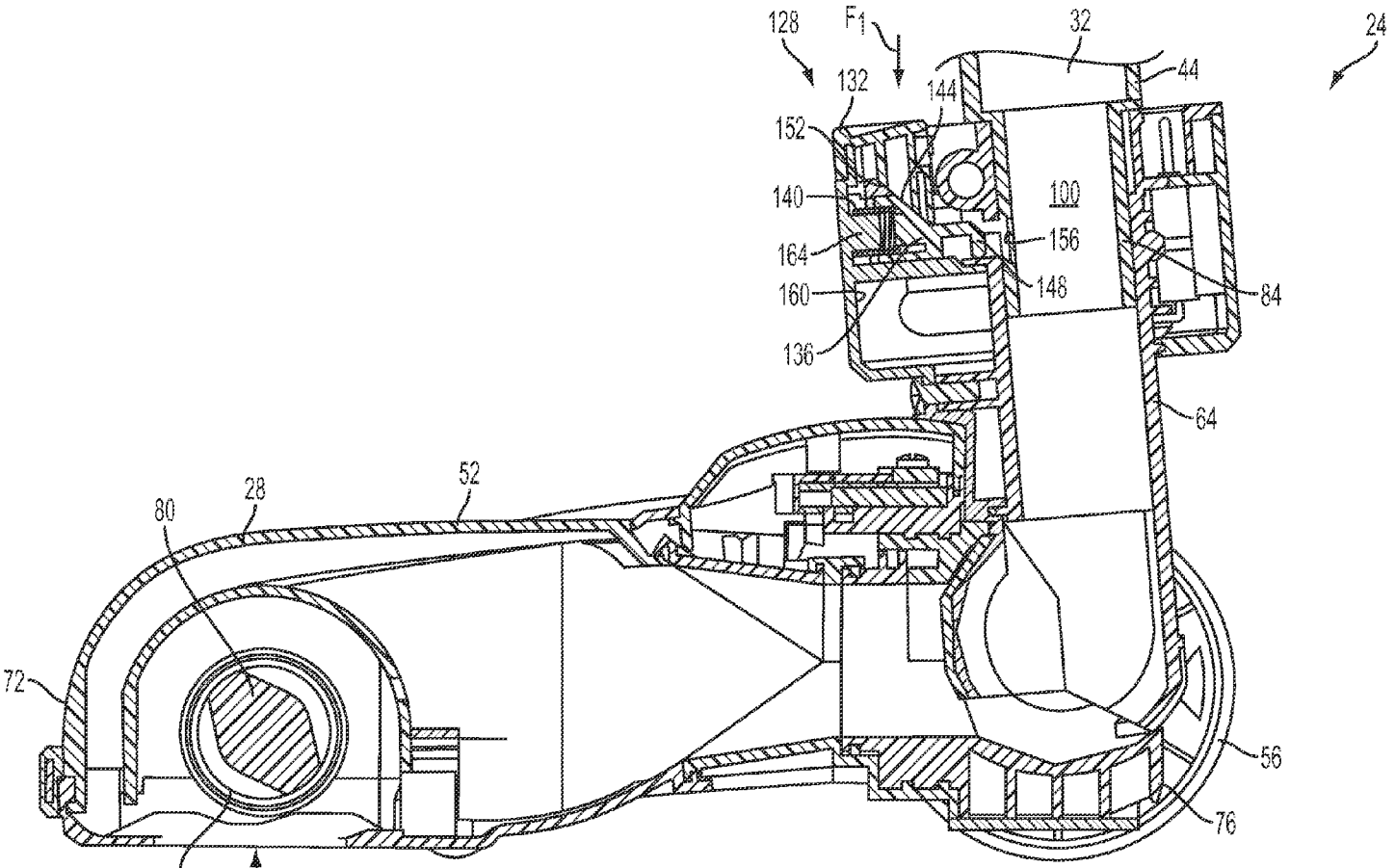
FIG. 10 is the cross-sectional view of the portion of the vacuum cleaner shown in FIG. 9 with the latch in a disengaged position.

As discussed above, the handle assembly 32 is movable relative to the foot 28 between a first position (FIGS. 1A-2), in which the handle assembly 32 is connected to the foot 28, and a second position (FIG. 3), in which the handle assembly 32 is disconnected from the foot 28. As shown in FIGS. 7, 9, and 10, the vacuum cleaner 20 includes a latch 128 to releasably secure the handle assembly 32 to the foot 28. In the illustrated embodiment, the latch 128 is supported by the stem 64 of the foot 28 and engages the extension tube 44 of the handle assembly 32 to selectively secure the handle assembly 32 to the foot 28. In other embodiments, the latch 128 may be supported by the handle assembly 32 and may engage a portion of the foot 28 to selectively secure the handle assembly 32 to the foot 28.

The illustrated latch 128 includes a foot pedal 132, a wedge 136, and a biasing member 140. The foot pedal 132 extends outwardly from the stem 64 for actuation by a user. In particular, the foot pedal 132 is configured to be depressed by a foot of the user stepping on the foot pedal 132. As shown in FIGS. 9 and 10, the wedge 136 is positioned within the stem 64. The wedge 136 includes a ramped surface 144 and a projection 148. The ramped surface 144 of the wedge 136 engages a corresponding ramped surface 152 of the foot pedal 152. The projection 148 is configured to fit within a groove 156 (FIG. 8) formed in the first end 84 of the extension tube 44. The biasing member 140 is positioned between the wedge 136 and an inner surface 160 of the stem 64. The biasing member 140 biases the wedge 136 toward and into engagement with the handle assembly 32. In the illustrated embodiment, the biasing member 140 is a coil spring mounted on a boss 164 that extends from the inner surface 160 of the stem 64. In other embodiments, other suitable biasing members may also or alternatively be employed.

FIG. 9 illustrates the latch 128 in an engaged position. In this position, the foot pedal 132 is fully extended from the stem 64, and the projection 148 extends into the groove 156 (FIG. 8) of the extension tube 44 to secure the handle assembly 32 within the stem 64. When a force $F_1$ is applied to the foot pedal 132 to actuate (e.g., depress) the foot pedal 132, as shown in FIG. 10, the ramped surface 152 of the foot pedal 132 slides along the ramped surface 144 of the wedge 136 to move the wedge 136 against the bias of the biasing member 140. The projection 148 of the wedge 136 slides out of the groove 156 (FIG. 8) in the extension tube 44 to release the handle assembly 32. The handle assembly 32 can then be disconnected from the foot 28 by pulling the extension tube 44 out of the stem 64.

The latch 128 is positioned on the vacuum cleaner 20 so that the foot pedal 132 is inoperable when the canister assembly 36 is supported by the base 24. That is, the foot pedal 132 cannot be actuated by a user to release the handle assembly 32 from the foot 28 while the canister assembly 36 is connected to the base 24 in the first cleaning mode, as shown in FIGS. 1A and 1B. Such an arrangement inhibits the handle assembly 32 from being disconnected from the foot 28 before the canister assembly 36 is removed from the base 24. Furthermore, such an arrangement inhibits the foot pedal 132 from being unintentionally actuated when the vacuum cleaner 20 is being operated in the first cleaning mode.

Figure 11:
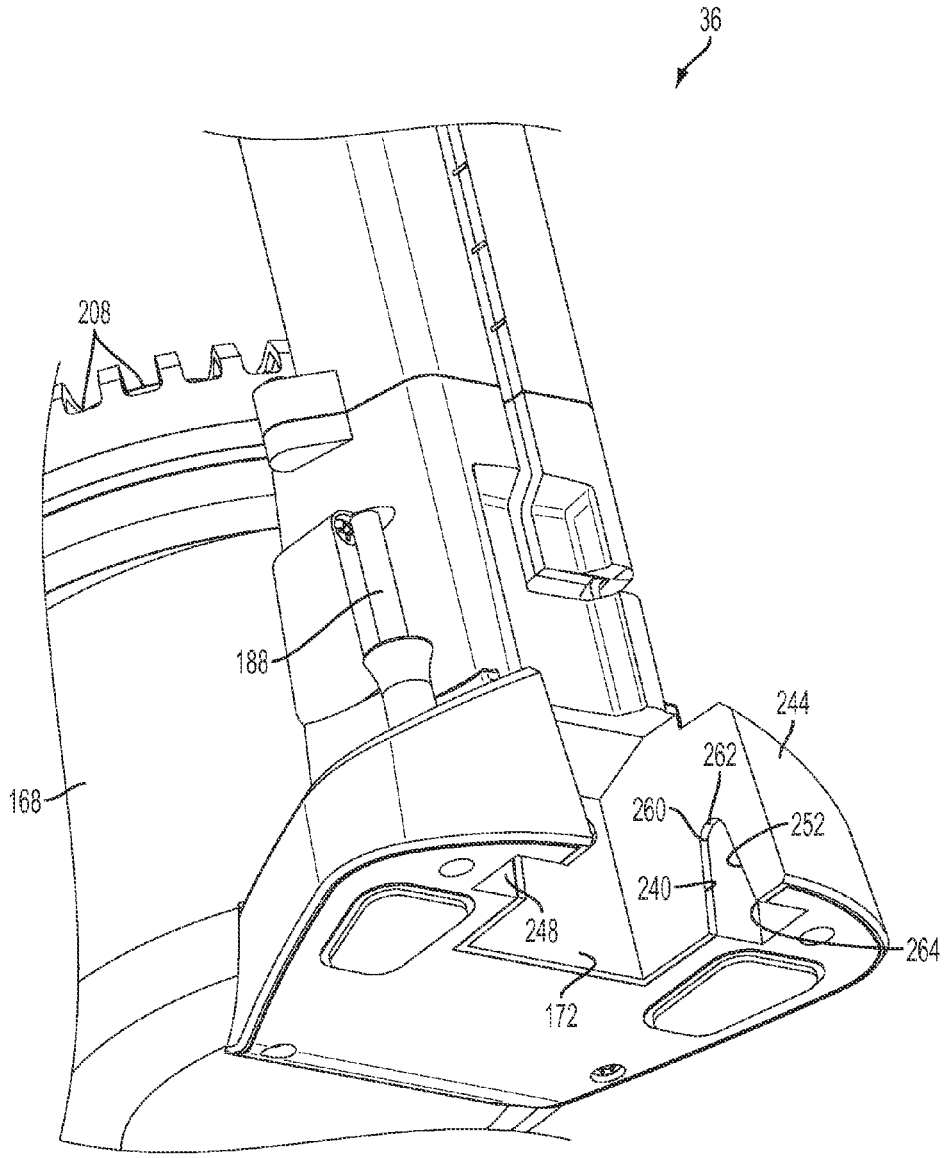
FIG. 11 is a bottom perspective view of a portion of the canister assembly of the vacuum cleaner.

In the illustrated embodiment, the latch 128 is substantially covered by the canister assembly 36 when the canister assembly 36 is supported by the base 24 such that the latch 128 is inaccessible to a user. As shown in FIG. 11, a body 168 of the canister assembly 36 defines a recess 172. The recess 172 is shaped and sized to provide sufficient clearance for the latch 128 (specifically, the foot pedal 132) when the canister assembly 36 is on the base 24. The latch 128 is received in the recess 172 of the canister assembly 36 when the canister assembly 36 is supported by the base 24 so that the body 168 of the canister assembly 36 does not contact or interfere with the foot pedal 132. In the illustrated embodiment, the canister assembly 36 and the foot pedal 132 are located on a forward side of the base 24 so that the canister assembly 36 overhangs a portion of the foot 28. In other embodiments, the canister assembly 36 and/or the foot pedal 132 may be located on a rearward side of the base 24.

Referring back to FIGS. 5 and 6, the illustrated canister assembly 36 includes the body 168, a suction motor 176 positioned within the body 168, a separator unit 180 supported by the body 168, and a dirt collection unit 184 supported by the body 168. The suction motor 176 is housed within a lower portion of the body 168 and includes an electric motor and a fan. The suction motor 176 is operable to generate a vacuum or suction force in the canister assembly 36. When the canister assembly 36 is connected to the handle assembly 32 and the handle assembly 32 is connected to the foot 28, the suction motor generates the suction force through the first conduit 100 of the handle assembly 32 and the suction nozzle 68 of the foot 28. A power cord 188 (only a portion of which is shown in FIGS. 1A-4) extends into the canister assembly 36 to provide power to the suction motor 176. The power cord 188 is also electrically connected to the grip 48 through the flexible hose 40 (FIGS. 1A-4) to provide electrical power to the handle assembly 32 and the foot 28.

The separator unit 180 and the dirt collection unit 184 are supported by the body 168 generally above the suction motor 176. In the illustrated embodiment, the separator unit 180 is a cyclonic separator unit. The cyclonic separator unit 180 includes a two-stage cyclone system including a first, upstream cyclone 190 and a second, downstream cyclone 192 positioned within the first cyclone 190. The cyclones 190, 192 are operable to separate dirt particles from an airflow. The cyclonic separator unit also includes a filter 196 to separate additional dirt particles from the airflow. The illustrated filter 196 is positioned downstream of (above in FIGS. 5 and 6) the second cyclone 192. The separator unit 180 further includes an inlet 200 (FIGS. 1A-4) connected to the flexible hose 40 to receive the airflow from the handle assembly 32. The dirt collection unit 184 is in fluid communication with the cyclone 192 to collect the dirt particles that are separated from the airflow by the separator unit 180. In other embodiments, other suitable separator units and/or dirt collection units may also or alternatively be employed. For example, in some embodiments, the canister assembly 36 may be a bag unit such that the separator unit 180 is omitted and the dirt collection unit 184 includes a bag positioned within the body 168.

In operation, when the suction motor 176 is energized, an airflow is drawn by the suction motor 176 into the vacuum cleaner 20 through the suction nozzle 68 in the foot 28. The foot 28 directs the airflow into the first conduit 100 of the handle assembly 32, which directs the airflow into the flexible hose 40 (FIGS. 1A-4). The flexible hose 40 directs the airflow into the separator unit 180 of the canister assembly 36. The airflow then circulates sequentially within the first and second cyclone 190, 192 to remove relatively large dirt and particles from the airflow. The airflow also passes through the filter 196 of the separator unit 180 to remove relatively small dirt and particles from the airflow. After passing through the filter 196, the airflow is directed through a conduit 204 in the body 168 toward the suction motor 176. The cleaned airflow is then exhausted out of the body 168 through vents 208 (FIG. 1A) formed in an upper surface of the body 168 that supports the separator and dirt collection units 180, 184.

The illustrated separator and dirt collection units 180, 184, or dirt cup, are manufactured and assembled together as a subassembly of the canister assembly 36. The separator and dirt collection units 180, 184 are removable from the body 168 to facilitate changing or cleaning the filter 196 and emptying the dirt collection unit 184. In the illustrated embodiment, the canister assembly 36 includes a latch 212 having a manual actuator 216 to selectively secure the units 180, 184 to the body 168. The actuator 216 is actuatable (e.g., depressible) by a user to release the separator and dirt collection units 180, 184 from the body 168. When released, the units 180, 184 can be lifted away from the body 168 and the suction motor 176.

As shown in FIGS. 1A-4, the canister assembly 36 also includes a handle 220 extending from the separator unit 180. The handle 220 is configured to be grasped by a user to facilitate carrying the canister assembly 36. For example, the handle 220 can be used to carry the separator unit 180 and the dirt collection unit 184 apart from the body 168 and the suction motor 176 of the canister assembly 36. In addition, when the separator and dirt collection units 180, 184 are secured to the body 168 by the latch 212, the handle 220 can be used to carry the entire canister assembly 36 apart from the handle assembly 32.

Referring to FIG. 2, the canister assembly 36 is removable from the base 24 to be carried along by a user separately from the handle assembly 32 and the foot 28. When the canister assembly 36 is not supported by the base 24, the canister assembly 36 remains in fluid communication with the handle assembly 32 and the foot 28 through the flexible hose 40. In the illustrated embodiment, the vacuum cleaner 20 includes a mounting post 224 and a latch 228 to mount and secure the canister assembly 36 to the base 24. In other embodiments, other suitable structures may also or alternatively be employed for connecting the canister assembly 36 to the base 24.

Figure 12:
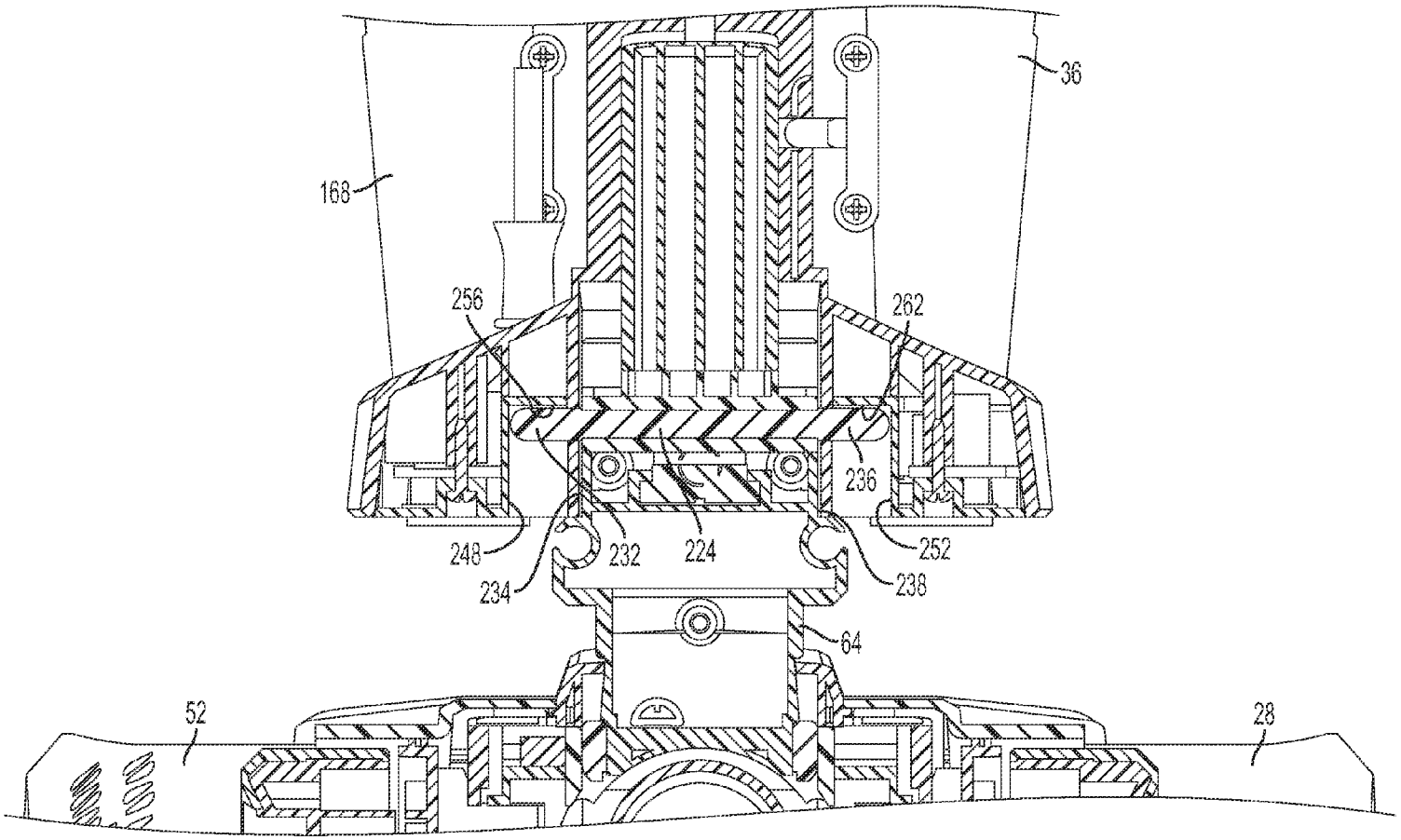
FIG. 12 is a cross-sectional view of a portion of the vacuum cleaner illustrating an interface between the foot and the canister assembly.

As shown in FIGS. 7 and 12, the mounting post 224 extends from the stem 64 of the foot 28 adjacent the latch 128 that releasably secures the handle assembly 32 to the foot 28. The mounting post 224 engages a portion of the canister assembly 36 to support the canister assembly 36 on the foot 28. In some embodiments, the mounting post 224 may extend from the extension tube 44 of the handle assembly 32 to engage the canister assembly 36. In other embodiments, the mounting post 224 may extend from the canister assembly 36 and engage the handle assembly 32 and/or the foot 28 to support the canister assembly 36 on the base 24.

The illustrated mounting post 224 is located adjacent the first end 84 of the handle assembly 32 so that a lower portion of the canister assembly 36 is engaged by the mounting post 224. The illustrated mounting post 224 is a pin that extends through the stem 64 of the foot 28. As shown in FIG. 12, a first end portion 232 of the post 224 extends outwardly from a first side 234 of the stem 64 in one direction, and a second end portion 236 of the post 224 extends outwardly from a second side 236 the stem 64 that is opposite the first side 234 in an opposite direction. The end portions 232, or engagement members, form bosses that extend outwardly from the stem 64. The two end portions 232, 236 engage the canister assembly 36 at two discrete locations to inhibit the canister assembly 36 from rotating around or about the handle assembly 32 when supported by the mounting post 224. In other embodiments, the mounting post 224 may include two separate pins that extend outwardly from the foot 28. In still other embodiments, the mounting post 224 may be a single ledge or surface on the base 24 that is configured to support the canister assembly 36.

The mounting post 224 is configured to be received in a groove 240 of the canister assembly 36 to support the canister assembly 36. As shown in FIG. 11, the groove 240 is formed in a rear surface 244 of the body 168 of the canister assembly 36 adjacent the recess 172 that receives the foot pedal 132. The illustrated groove 240 is divided by the recess 172 into two discrete groove portions 248, 252. The first groove portion 248 receives the first end portion 232 of the mounting post 224, while the second groove portion 252 receives the second end portion 236 of the mounting post 224. Surfaces 256, 260 of the body 168 that define the groove portions 248, 252 rest on the end portions 232, 236 of the mounting post 224 such that the canister assembly 36 is pivotable relative to the handle assembly 32 while being supported by the mounting post 224. In addition, each groove portion 248, 252 increases in cross-sectional area from a closed end 262 to an open end 264. The open ends 264 of the groove portions 248, 252 are thereby larger to facilitate inserting the mounting post 224 into the groove 240 when connecting the canister assembly 36 to the foot 28. Such an arrangement allows a user to be less exact when aligning the canister assembly 36 on the base 24.

The recess 172 and the groove 240 are formed in the rear surface 214 of the canister assembly 36 such that a portion of the stem 64 is received within the recess 172 when the canister assembly 36 is supported by the mounting post 224. In particular, a portion of the body 168 of the canister assembly 36 extends over portions of the first and second sides 234, 238 (FIG. 12) of the stem 64 such that the canister assembly 36 straddles the stem 64. Such an arrangement inhibits the canister assembly 36 from sliding, rocking, shifting, or otherwise moving side-to-side relative to the handle assembly 32 when supported by the mounting post 224. In addition, such an arrangement helps position the canister assembly 36 on the base 24 so that the latch 228 on the canister assembly 36 properly aligns with a corresponding structure of the handle assembly 32.

Figure 13:
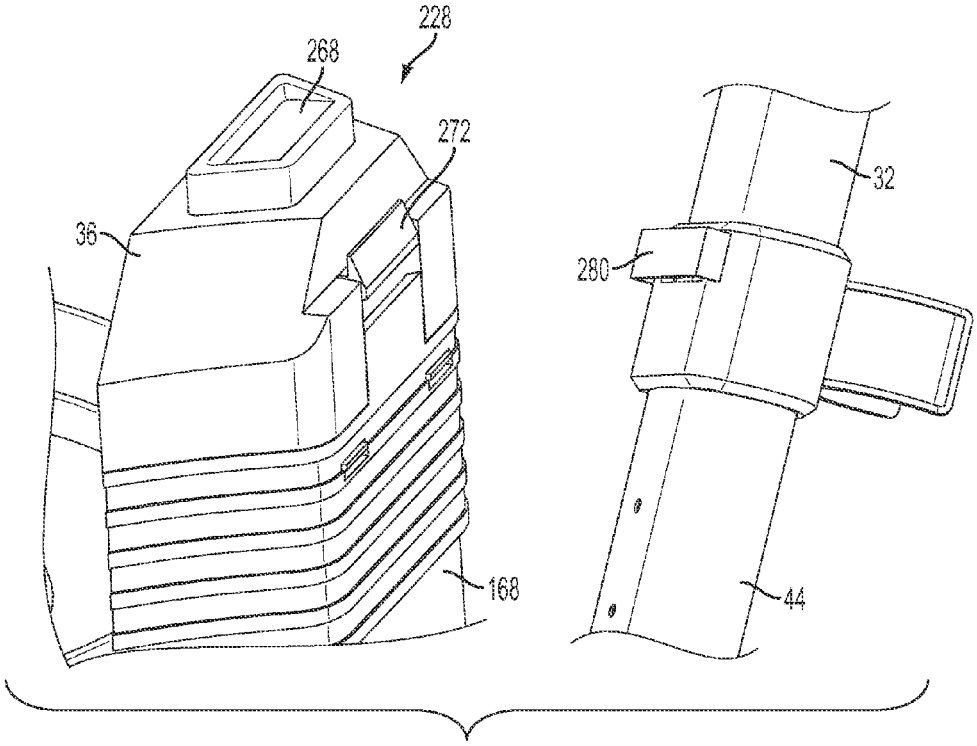
FIG. 13 is an exploded perspective view of portions of the canister assembly and the handle assembly.
Figure 14:
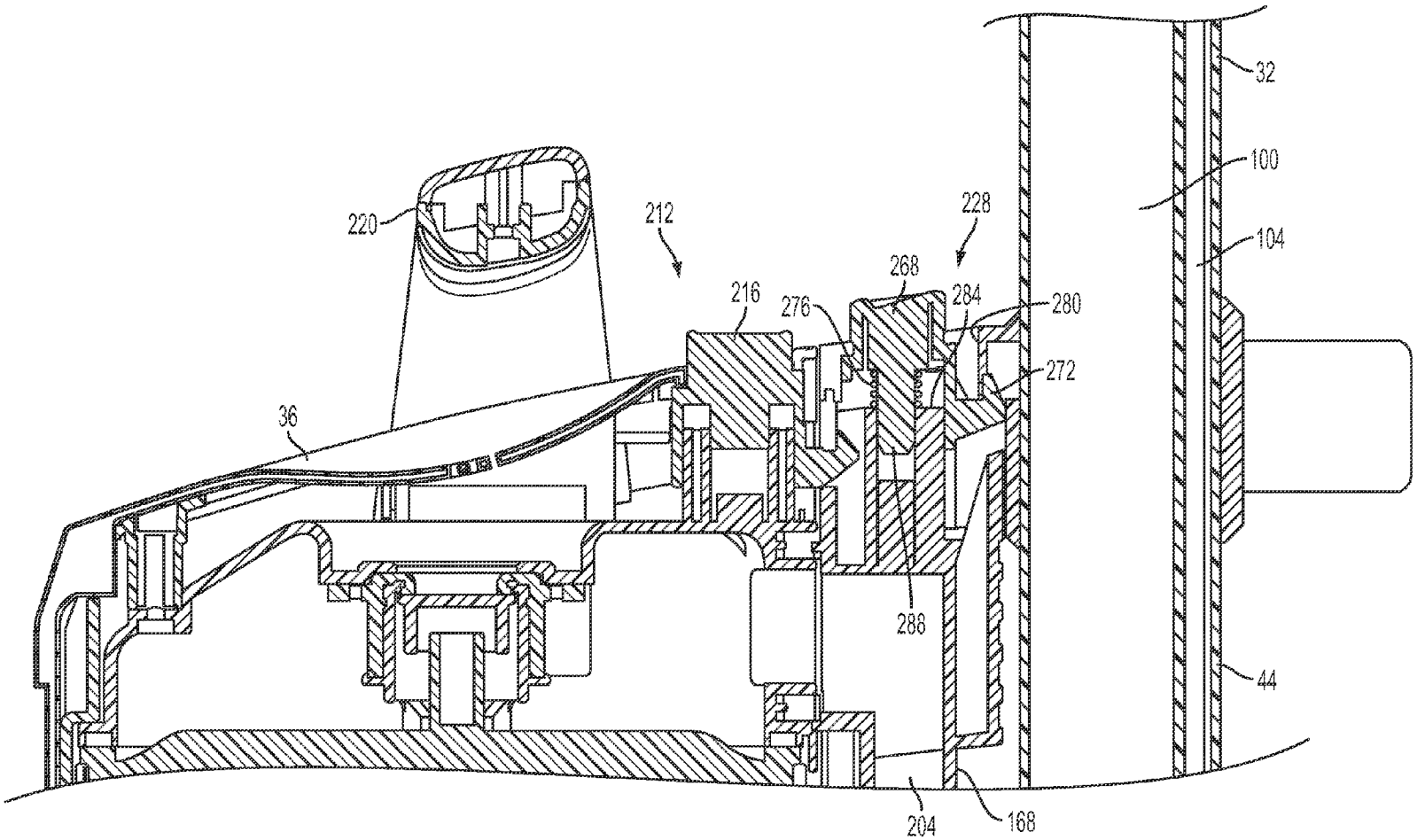
FIG. 14 is a cross-sectional view of a portion of the vacuum cleaner illustrating an interface between the canister assembly and the handle assembly, the canister assembly supporting a latch in an engaged position.
Figure 15:
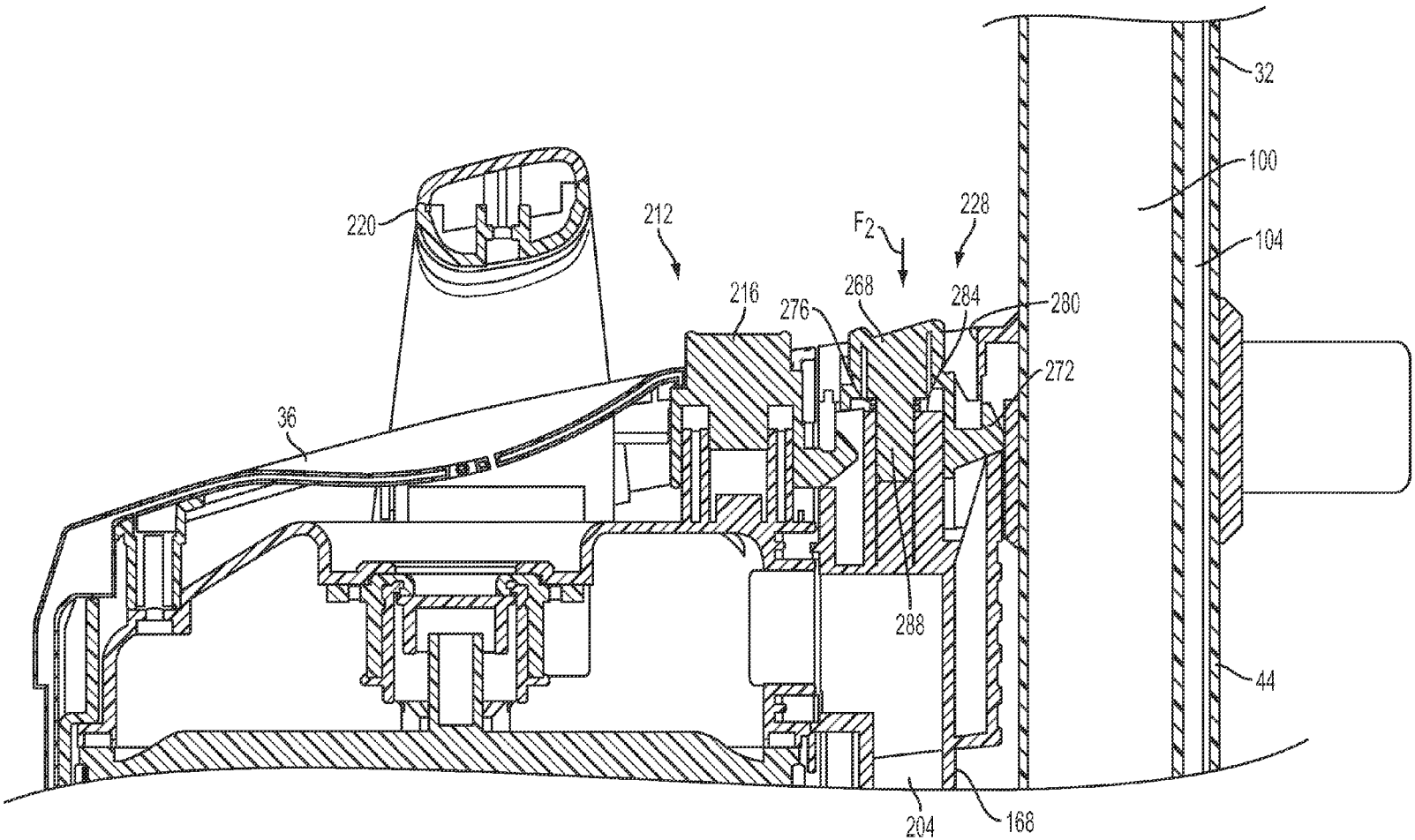
FIG. 15 is the cross-sectional view of the portion of the vacuum cleaner shown in FIG. 14 with the latch in a disengaged position.

As shown in FIGS. 13-15, the latch 228 is supported by the canister assembly 36. The illustrated latch 228, or engagement member, is supported at an upper end of the canister assembly 36 opposite from the suction motor 176. The latch 228 is operable to engage a portion of the handle assembly 32 to releasably secure the canister assembly 36 to the handle assembly 32. The latch 228 is located on the canister assembly 36 between the first and second ends 84, 88 of the extension tube 44. In particular, the latch 228 is located between the grip 48 of the handle assembly 32 and the mounting post 224. With the mounting post 224, the latch 228 provides a three-point connection (two points on the mounting post 224 and one point on the latch 228) for connecting the canister assembly 36 to the handle assembly 32 and the foot 28.

In the illustrated embodiment, the latch 228 includes a manual actuator 268, a hook 272, and a biasing member 276 (FIGS. 14 and 15). The manual actuator 268 extends outwardly from the body 168 of the canister assembly 36 to be actuated (e.g., depressed) by a user. The hook 272 is configured to engage a flange 280 of the handle assembly 32 to secure the latch 228 to the handle assembly 32. The illustrated hook 272 is integrally formed as a single piece with the actuator 268. In other embodiments, the actuator 268 and the hook 272 may be separate elements that are coupled together. Additionally or alternatively, in some embodiments, the latch 228 may be supported by the handle assembly 32, and the flange 280 may be formed on the canister assembly 36.

As shown in FIGS. 14 and 15, the biasing member 276 is positioned between the actuator 268 and an inner surface 284 of the body 168. The biasing member 276 biases the hook 272 into engagement with the flange 280. In the illustrated embodiment, the biasing member 276 is a coil spring that surrounds a boss 288 of the actuator 268. In other embodiments, other suitable biasing members may also or alternatively be employed.

FIG. 14 illustrates the latch 228 in an engaged position. In this position, the manual actuator 268 is fully extended from the body 168 of the canister assembly 36, and the hook 272 extends behind the flange 280 to engage the flange 280 and secure the canister assembly 36 to the handle assembly 32. When a force $F_2$ is applied to the actuator 268 to move the actuator 268 against the bias of the biasing member 276, as shown in FIG. 15, the hook 272 moves (e.g., slides) away from the flange 280. Once the hook 272 clears the flange 280, the canister assembly 36 is released from the handle assembly 32. The canister assembly 36 can then be removed from the base 24.

Referring to FIGS. 5 and 6, the canister assembly 36 is removable from the handle assembly 32 and the foot 28 using a rocking or pivoting motion and a lifting motion. Initially, the canister assembly 36 is supported by the mounting post 224 and secured to the handle assembly 32 by the latch 228. When the latch 228 is actuated to disengage the flange 280, the canister assembly 36 can be pivoted about the mounting post 224 relative to the handle assembly 32 and the foot 28. As shown in FIG. 6, the canister assembly 36 is pivotable in a first direction A (counterclockwise in FIG. 6) away from the handle assembly 32 when the latch 228 disengages the flange 280 on the handle assembly 32. After being pivoted a sufficient distance away from the handle assembly 32, the canister assembly 36 (which includes the suction motor 176, the separator unit 180, and the dirt collection unit 184) can be lifted as a single assembly off of the mounting post 224 to operate the vacuum cleaner 20 in the second, third, or fourth cleaning modes, as shown in FIGS. 2-4. Separating the canister assembly 36 from the handle assembly 32 and the foot 28 also allows the foot pedal 132 (FIG. 7) to be actuated to disconnect the handle assembly 32 from the foot 28.

The canister assembly 36 can be reconnected to the handle assembly 32 and the foot 28 using a substantially opposite set of motions. First, the groove 240 (FIG. 11) in the canister assembly 36 is generally aligned with the mounting post 224. Once aligned, the canister assembly 36 is lowered onto the mounting post 224 such that the mounting post 224 is received in the groove 240 and the canister assembly 36 is supported by the foot 28. The canister assembly 36 is then pivoted in a second direction (clockwise in FIG. 6) opposite the first direction A and toward the handle assembly 32. As the canister assembly 36 is pivoted toward the handle assembly 32, the hook 272 of the latch 228 engages the flange 280 of the handle assembly 32. The hook 272 is configured to automatically move against the bias of the biasing member 276 and out of the way of the flange 280 as the canister assembly 36 is being connected to the handle assembly 32 without requiring a user to actuate the manual actuator 268. Once the hook 272 clears the flange 280, the biasing member 276 biases the hook 272 back into engagement behind the flange 280 to secure the canister assembly 36 to the handle assembly 32. Biasing the latch 228 into engagement with the flange 280 also provides an audible "click" to notify the user that the canister assembly 36 is properly connected to the handle assembly 32.

In some embodiments, the relative locations of the mounting post 224 and the latch 228 may be reversed. For example, the latch 228 may be located adjacent the first end 84 of the handle assembly 32, and the mounting post 224 may be located between the grip 48 of the handle assembly 32 and the latch 228. In such embodiments, the canister assembly 36 may still be removed from and reconnected to the handle assembly 32 and the foot 17 in a similar manner as described above. However, a bottom portion of the canister assembly 36 (rather than an upper portion) may be pivoted toward and away from the handle assembly 32 when the canister assembly 36 is installed on and removed from the base 24.

Various features and advantages of the invention are set forth in the following claims.

What is claimed is:

1. A vacuum cleaner comprising:

a base including a foot having a suction nozzle, and a handle assembly removably coupled to the foot, the handle assembly movable between a first position, in which the handle assembly is connected to the foot, and a second position, in which the handle assembly is disconnected to the foot;

a canister assembly supported by base, the canister assembly being removable from the base; and a latch supported by one of the foot and the handle assembly, the latch engageable with the other of the foot and the handle assembly to selectively secure the handle assembly to the foot, the latch being inaccessible when the canister assembly is supported by the base.

2. The vacuum cleaner of claim 1, wherein the latch is substantially covered by the canister assembly when the canister assembly is supported by the base.

3. The vacuum cleaner of claim 2, wherein the canister assembly includes a body that defines a recess, and wherein the latch is received in the recess when the canister assembly is supported by the base.

4. The vacuum cleaner of claim 3, wherein the canister assembly also includes a suction motor positioned within the body, and wherein the suction motor is operable to generate a suction force through the suction nozzle.

5. The vacuum cleaner of claim 4, wherein the canister assembly further includes a separator unit and a dirt collection unit supported by the body, wherein the separator unit receives an airflow from the suction nozzle when the handle assembly is in the first position and is operable to separate dirt particles from the airflow, and wherein the dirt collection unit is configured to collect the dirt particles that are separated from the airflow by the separator unit.

6. The vacuum cleaner of claim 1, wherein the latch is supported by the foot, wherein the handle assembly defines a groove, and wherein a portion of the latch extends into the groove to selectively secure the handle assembly to the foot.

7. The vacuum cleaner of claim 1, wherein the latch includes a foot pedal, and wherein the foot pedal is actuatable to disengage the latch from the other of the foot and the handle assembly.

8. The vacuum cleaner of claim 7, wherein the latch also includes a wedge, wherein the wedge engages the other of the foot and the handle assembly to selectively secure the handle assembly to the foot, and wherein the foot pedal is actuatable to move the wedge out of engagement with the other of the foot and the handle assembly.

9. The vacuum cleaner of claim 8, wherein the latch further includes a biasing member, wherein the biasing member biases the wedge into engagement with the other of the foot and the handle assembly, and wherein the foot pedal is actuatable to move the wedge against the bias of the biasing member.

10. The vacuum cleaner of claim 1, wherein the handle assembly includes an extension tube having a first end and a second end, wherein the first end of the extension tube connects to the foot, and wherein the second end of the extension tube supports a grip.

11. The vacuum cleaner of claim 10, wherein the foot includes a body and a stem extending from the body, wherein the body defines the suction nozzle, and wherein the stem receives the first end of the extension tube to connect the handle assembly to the foot.

12. The vacuum cleaner of claim 11, wherein the stem is movable relative to body so that the handle assembly is pivotable relative to the foot between an upright storage position and an inclined operating position when the handle assembly is connected to the stem.

13. The vacuum cleaner of claim 10, wherein the extension tube defines a first conduit and a second conduit, wherein the first conduit provides an airflow pathway between the suction nozzle and the canister assembly when the handle assembly is connected to the foot, and wherein the second conduit provides an electrical pathway to the foot when the handle assembly is connected to the foot.

14. The vacuum cleaner of claim 1, wherein the foot includes a plurality of wheels and an agitator.

15. A vacuum cleaner comprising:

a base including a foot having a suction nozzle, and a handle assembly removably coupled to the foot, the handle assembly movable between a first position, in which the handle assembly is connected to the foot, and a second position, in which the handle assembly is disconnected to the foot;

a canister assembly supported by the base, the canister assembly being removable from the base; and a foot pedal operable to release the handle assembly from the foot to allow movement of the handle assembly from the first position to the second position, the foot pedal being inoperable when the canister assembly is supported by the base.

16. The vacuum cleaner of claim 15, wherein the foot pedal is substantially covered by the canister assembly when the canister assembly is supported by the base.

17. The vacuum cleaner of claim 16, wherein the canister assembly includes a body that defines a recess, and wherein the foot pedal is received in the recess when the canister assembly is supported by the handle assembly.

18. The vacuum cleaner of claim 17, wherein the canister assembly also includes a suction motor positioned within the body, the suction motor operable to generate a suction force through the suction nozzle, a separator unit supported by the body to receive an airflow from the suction nozzle when the handle assembly is in the first position, the separator unit operable to separate dirt particles from the airflow, and a dirt collection unit supported by the body, the dirt collection unit configured to collect the dirt particles that are separated from the airflow by the separator unit.

19. The vacuum cleaner of claim 15, wherein the foot pedal is supported by the foot.

20. The vacuum cleaner of claim 15, further comprising:

a wedge coupled to the foot pedal, the wedge engageable with one of the foot and the handle assembly to selectively secure the handle assembly to the foot; and a biasing member coupled to the wedge to bias the wedge into engagement with the one of the foot and the handle assembly;

wherein the foot pedal is actuatable to move the wedge out of engagement with the one of the foot and the handle assembly against the bias of the biasing member.

21. The vacuum cleaner of claim 20, wherein the handle assembly defines a groove, and wherein a portion of the wedge extends into the groove to selectively secure the handle assembly to the foot.

22. The vacuum cleaner of claim 15, wherein the handle assembly includes an extension tube having a first end and a second end, wherein the first end of the extension tube connects to the foot, and wherein the second end of the extension tube supports a grip.

23. The vacuum cleaner of claim 22, wherein the foot includes a body and a stem extending from the body, wherein the body defines the suction nozzle, and wherein the stem receives the first end of the extension tube to connect the handle assembly to the foot.

24. The vacuum cleaner of claim 23, wherein the stem is movable relative to body so that the handle assembly is pivotable relative to the foot between an upright storage position and an inclined operating position when the handle assembly is connected to the stem.

25. The vacuum cleaner of claim 22, wherein the extension tube defines a first conduit and a second conduit, wherein the first conduit provides an airflow pathway between the suction nozzle and the canister assembly when the handle assembly is connected to the foot, and wherein the second conduit provides an electrical pathway to the foot when the handle assembly is connected to the foot.

26. The vacuum cleaner of claim 15, wherein the foot includes a plurality of wheels and an agitator.

* * * * *